United States Patent [19]

Ceretti

[11] 4,449,924

[45] May 22, 1984

[54] INDUSTRIAL FURNACE

[76] Inventor: Claudia Ceretti, Via Ida Braggio n. 1, Domodossola, Italy

[21] Appl. No.: 366,210

[22] Filed: Apr. 7, 1982

[30] Foreign Application Priority Data

Apr. 14, 1981 [IT] Italy ..... 67513 A/81

[51] Int. Cl.[3] ..... F27B 9/16; B66C 17/08; F23K 3/00

[52] U.S. Cl. ..... 432/138; 414/147; 414/172; 414/195

[58] Field of Search ..... 432/131, 138, 139; 414/147, 172, 195

[56] References Cited

U.S. PATENT DOCUMENTS

| | | | |
|---|---|---|---|
| 1,647,050 | 10/1927 | Mackay | 432/131 |
| 2,488,115 | 11/1949 | Benos | 432/131 |
| 4,191,529 | 3/1980 | Harrell et al. | 414/172 |

FOREIGN PATENT DOCUMENTS

| | | | |
|---|---|---|---|
| 640489 | 7/1928 | France | 432/131 |
| 290837 | 5/1928 | United Kingdom . | |
| 355664 | 8/1931 | United Kingdom . | |
| 413134 | 7/1934 | United Kingdom . | |
| 426728 | 4/1935 | United Kingdom . | |
| 460913 | 2/1937 | United Kingdom . | |
| 589096 | 6/1947 | United Kingdom . | |
| 1300874 | 12/1972 | United Kingdom . | |
| 1474211 | 5/1977 | United Kingdom . | |
| 1516402 | 7/1978 | United Kingdom . | |
| 2003918 | 9/1978 | United Kingdom . | |

*Primary Examiner*—John J. Camby
*Attorney, Agent, or Firm*—McGlew and Tuttle

[57] ABSTRACT

An industrial furnace, for instance a heating and/or reducing furnace, arranged to treat material in powder or in small pieces and having a chamber with refractory walls to which energy is supplied by electric means and/or by combustion and into which the material to be treated is charged. The material is moved forward from an inlet orifice to a discharge orifice by a member provided with teeth which are preferably hollow and are cooled by water, air or vapor circulation.

12 Claims, 6 Drawing Figures

FIG. 1
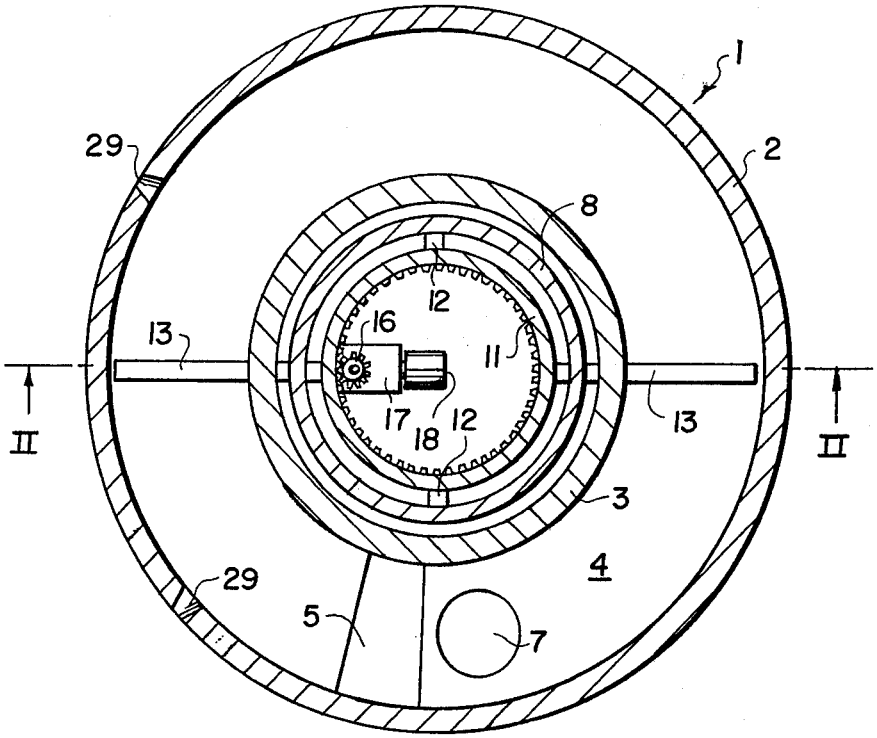
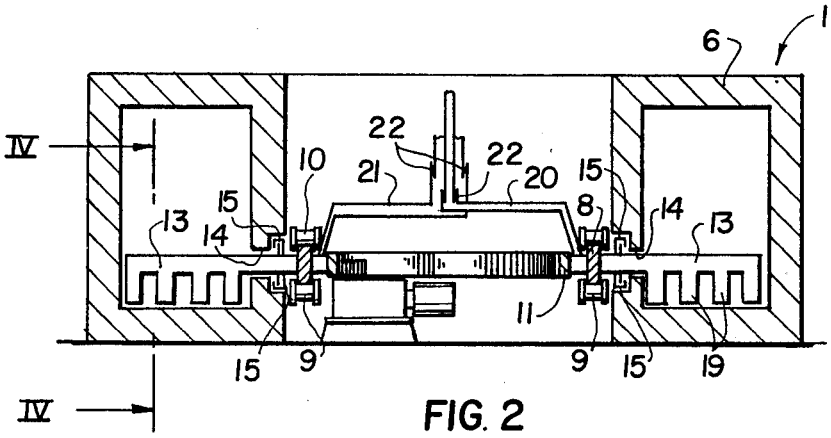
FIG. 2

INDUSTRIAL FURNACE

FIELD AND BACKGROUND OF THE INVENTION

The present invention relates to an industrial furnace, and more particularly to a heating and/or reducing furnace for treating materials in powder form and/or in small pieces.

The furnaces intended for such operations have a small thermal efficiency as the material becomes strongly heated at the surface exposed to the heat source but badly transmits the heat to the interior of the bulk. Moreover these furnaces are complex and therefore expensive; in particular they use complex means to move the material from the charge to the discharge orifices and often the reducing furnaces cannot use the combustible gases, in particular the carbon monoxide, developing during the reduction process.

SUMMARY OF THE INVENTION

The invention aims to obviate to the above mentioned drawbacks and to provide a furnace which is simple to construct and easy to operate, and which has a long life and allows a continuous operation.

In its more general aspect, the furnace comprises a chamber which has refractory walls and is arranged to receive thermal energy from electric means and/or from a fuel. The chamber has inlet and discharge orifices and is equipped with means which stir the material inside the chamber and push it from the inlet zone to the discharge zone.

These stirring and pushing means comprise a movable rod ending in a cross-bar having downwardly projecting teeth.

In case the furnace is to operate at a relatively high temperature, above 1000° C., the movable rod, the cross-bar and the teeth are hollow elements in which a cooling fluid can flow.

The furnace according to the invention may have several different shapes. To achieve the above mentioned requirements of simplicity, the chamber can suitably have either a circular or a rectilinear plan.

The stirring and pushing means, consisting of said moving rod, cross-bar and teeth, may have cavities of relatively large sections, through which the whole furnace charge or a part thereof can also pass.

BRIEF DESCRIPTION OF THE DRAWINGS

The invention will be better understood with reference to the accompanying drawings, in which:

FIG. 1 is a horizontal cross sectional view of a furnace according to the invention, of the annular type;

FIG. 2 is a vertical cross section through the annular furnace of FIG. 1 and taken on line II—II of FIG. 1;

DESCRIPTION OF THE PREFERRED EMBODIMENTS

Figure 3:
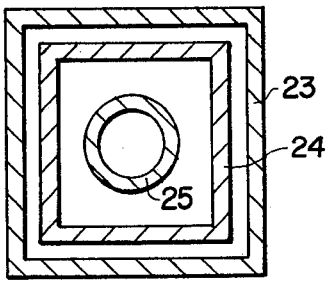
FIG. 3 is a horizontal cross-section on enlarged scale of a tooth for pushing the material, taken on line III—III of FIG. 4.

According to the invention, if the particulate material to be heated is also to be reduced, for instance with coal, so that carbon monoxide develops during the reaction phase, by introducing into the furnace air, which is possibly pre-heated, the combustion of CO to $CO_2$ can be exploited within the furnace. The furnace can have burning nozzles or even air supplying nozzles.

If coal in powder form or in small pieces is introduced into the furnace, it can be gasified with air or even water, producing CO and $H_2$.

According to a first embodiment (FIGS. 1 and 2) the furnace, when viewed in plan, has the shape of an annulus delimited by outer and inner refractory walls 2, 3, connected by a sole 4 having a discharge orifice 5 and by a crown 6 through which a charge duct 7 is realized. Wall 2 is pierced by burners 29.

Internally to wall 3 a metal gear or ring 8 is supported by a set of rollers 9 and is kept in its position by a second set of upper rollers 10. The gear or ring is rigidly linked to another gear 11 internal to the first one and fastened thereto by spokes 12 and arms 13 which pass through inner wall 3. To permit the passage (and motion) of arms 13, wall 3 has an opening 14 (FIG. 2) with a gas-tight labyrinth seal 15. Gear 11 is an internal gear and meshes with pinion 16 driven by reduction gear 17 in turn driven by motor 18.

As shown in FIG. 2, arms 13 extend over almost the whole radial width of the furnace chamber and have downwardly projecting teeth 19.

In correspondence with the furnace centre, at a certain height above gear 11, connecting members, for instance bars 20 and 21 linking arms 13, are provided.

According to a first embodiment such arms, as well as arms 13 and teeth 19, may be solid. In this case bars 20, 21 and the rotatable joint with seals 22, shown in FIG. 2, can be dispensed with. This solution is convenient when the furnace is intended for operation at relatively limited temperature, for instance up to 1000° C.

According to a second embodiment arms 20, 21, arms 13 and teeth 19 are hollow, and the respective cavities communicate with one another thereby allowing the circulation of a cooling fluid (for instance water, air, water vapour, gas, etc.) so that the furnace can operate at high temperature. In this case, as shown in FIG. 2, hollow bars 20, 21 are fed from the outside through a rotatable joint whose tightness is achieved through seals 22.

According to a third embodiment, besides said communicating cavities, other cavities are provided which communicate with the furnace interior, for instance through the tooth bottom. In this case the rotating seal joint comprises three coaxial tubular elements two of which serve for the inlet and outlet of the cooling fluid and the third is intended for the introduction of a material in powder form or in small pieces, such as ore and/or fuel, which forms a part or the whole of the furnace charge.

Figure 4:
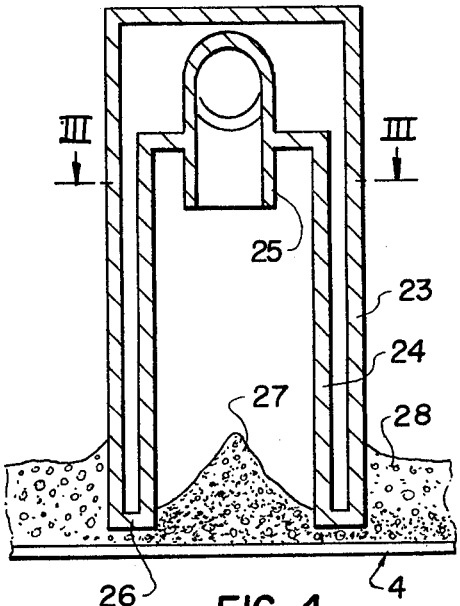
FIG. 4 is a vertical cross section of the tooth shown in FIG. 3.

A solution of this kind is shown in FIGS. 3 and 4, which are cross sectional views of a tooth 19 with a first, outer pipe 23, a central pipe 24 and an inner pipe 24. Pipes 23 and 24 are connected at their lower end by a square ring or bottom 26.

FIG. 4 shows material 27 outgoing from the tooth and material 28 lying on furnace sole 4.

The operation of the described furnace is as follows: through orifice 7 a first part of the material to be heated and/or treated is introduced; arms 13, driven by motor 18, rotate and through teeth 19 stir and push the material to be treated. After a run somewhat shorter than a complete turn, the material has been sufficiently heated for instance by burners 29 and has arrived at orifice 5 through which it falls into an underlying container.

In the case of the high-temperature furnace the coolant fluid arriving through the rotating joint with seals 22 cools arms 13 and teeth 19 and is upwardly discharged through the same rotating joint.

In the case of the third embodiment, the material is introduced through the cooled teeth (FIGS. 3, 4).

Figure 5:
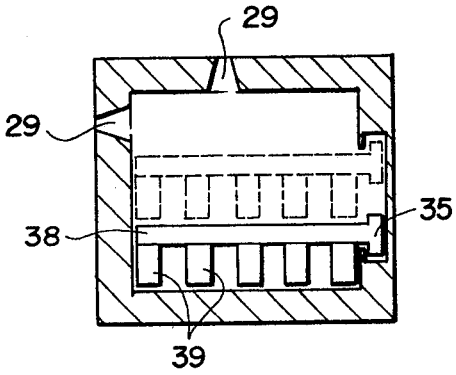
FIG. 5 is a vertical cross section of a furnace with rectilinear axis, taken on line V—V of FIG. 6.
Figure 6:
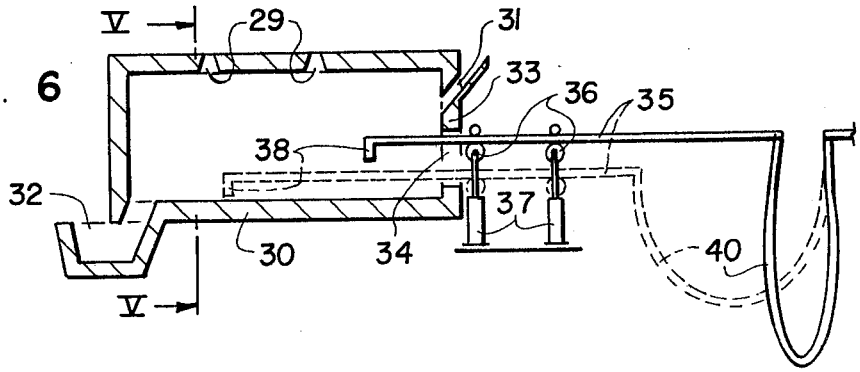
FIG. 6 is a vertical longitudinal section on a reduced scale of the furnace shown in FIG. 5.

FIGS. 5 and 6 show an embodiment of the invention including a furnace with rectilinear cross-section. In this case means are provided which allow reciprocation of the toothed arms, with means for lifting the arms and teeth to avoid, during the return stroke, the teeth coming into contact with the material thereby hindering the forward movement thereof. A chamber 30 of refractory material, preferably of parallelepipedal shape, with burners 29 in the crown and/or in the walls, has a charge opening 31 and a discharge opening 32. Vertical wall 33 has an opening 34 for passage of an arm 35 supported by rollers 36 driven by a motor, not shown. These rollers are in turn supported by jacks 37. Arm 35 ends within the furnace in a cross-bar 38 having teeth 39. At the opposite end arm 35, which is assumed to be hollow, is connected to at least a pipe 40 supplying the cooling fluid and/or the charge material.

The operation of the furnace is the same as that of the circular furnace, the only difference being that jacks 37, when arm 35 has ended its stroke to the left, allow it to be lifted to such an extent that the teeth are no longer in contact with the material, to move the arm back to the starting position. The crucible shown at output 32 can be heated by an electric arc or by a combustion torch thereby melting the material contained therein. The same arrangement may be provided for the container receiving the material from orifice 5 (FIG. 1).

The furnace according to the invention is very well suited to treat small material which in the conventional furnaces creates several difficulties.

It is self evident that in the practice of the invention, variants and modifications are possible without departing from the scope of the invention.

What I claim is:

1. An industrial furnace for heating particulate material, comprising:

a plurality of refractory walls defining a chamber having a floor;

heating means associated with said chamber for heating contents of said chamber;

at least one of said refractory walls including an inlet orifice communicating with said chamber for receiving particulate material into said chamber and a discharge orifice communicating with said chamber for discharging particulate material from said chamber;

at least one arm movable in said chamber in a substantially horizontal plane and over said floor for pushing particulate material toward said discharge orifice; and drive means connected to said arm for moving said arm in said chamber;

said arm including a plurality of spaced apart downwardly projecting teeth for stirring and moving particulate material on said floor of said chamber, said arm including a first passageway defined therein for the circulation of a coolant for cooling said arm with said teeth and a second passageway defined therein and communicating with said chamber through said teeth for the passage of particulate material into said chamber.

2. A furnace according to claim 1, wherein said arm defines said first passageways to be closed with respect to said chamber for circulating coolant in a closed cycle within said arm.

3. A furnace according to claim 1, wherein one of said plurality of refractory walls comprises a side wall having an opening therethrough, said arm extending through said opening and sealing means connected to said side wall and extending into said opening for sealing said opening with respect to said arm, said first passageway including a coaxial supply and return passage for circulation of coolant between said teeth, said first passageway extending into said teeth.

4. A furnace according to claim 3, wherein said arm defines said second passageway to include portions which are surrounded by said first passageway in said teeth and communicate with said chamber.

5. A furnace according to claim 1, wherein said plurality of refractory walls include an inner annular side wall and an outer annular side wall defining said chamber therebetween, a bottom wall connected between said inner and outer annular side walls defining said floor and a top wall, said discharge orifice extending through said bottom wall, said inner annular side wall defining a central area, said drive means including a ring rotatably mounted in said central area, said inner annular side wall having an opening therethrough communicating said central area with said chamber, said at least one arm connected to said ring and extending radially outwardly of said ring through said opening in said inner annular side wall and into said chamber, and a sealing labrynth connected to said inner annular side wall and extending into said opening and into association with said at least one arm for sealing said central area with respect to said chamber.

6. A furnace according to claim 5, wherein said drive means further comprises a driven gear connected to said ring, rollers rotatably mounted in said central area for supporting said ring for rotation, a driving gear meshed with said driven gear and motor means connected to said driving gear for rotating said driving gear.

7. A furnace according to claim 6, including an additional arm including first and second passageways defined therein for circulating coolant and supplying particulate material respectively, connected to and extending radially outwardly of said ring through said opening of said inner annular side wall, a central coolant pipe connected to each of said arms and rotatably mounted in said central area, and sealing joint means connected to said central coolant pipe in said central area for rotatably mounting said central coolant pipe and sealing said first passageway with respect to said central area.

8. A furnace according to claim 1, wherein each of said teeth comprises an outer pipe, a center pipe and an inner pipe, a bottom member connected between said outer and center pipe for closing a portion of said first passageway disposed between said outer and center pipe, said inner pipe defining a portion of said second passageway therein and communicating with said chamber.

9. A furnace according to claim 8, including an inner space defined by said center pipe on a side thereof opposite said outer pipe, said inner pipe communicating with a top of said space, a bottom of said space communicating with said chamber.

10. A furnace according to claim 1, wherein said plurality of refractory walls include at least one side wall having a window therethrough, said arm movable through said window in said chamber, said drive means comprising at least one jack having an end connected to said arm for raising and lowering said arm and drive rollers connected to said jack end and engaged with said arm for moving said arm horizontally in said chamber over said floor wherein said arm can be moved in a forward stroke adjacent said floor for moving particulate material toward said discharge orifice, and in a return stroke in a position spaced away from said floor.

11. A furnace according to claim 10, including a flexible pipe connected to an end of said arm spaced away from said teeth for defining a portion of said first and second passageways.

12. A furnace according to claim 10, wherein said arm includes a cross-bar extending at an angle to a direction of motion of said arm in the horizontal plane, said cross-bar including said downwardly extending teeth.

* * * * *